US005852926A

United States Patent [19]

Breedlove

[11] Patent Number: 5,852,926

[45] Date of Patent: Dec. 29, 1998

[54] BALANCED STRAND CORDAGE

[75] Inventor: James R. Breedlove, Watkinsville, Ga.

[73] Assignee: Wellington Leisure Products, Inc., Madison, Ga.

[21] Appl. No.: 918,762

[22] Filed: Aug. 25, 1997

[51] Int. Cl.[6] ..... D02G 3/02

[52] U.S. Cl. ..... 57/210; 57/200; 57/230; 57/231

[58] Field of Search ..... 57/200, 210, 230, 57/231

[56] References Cited

U.S. PATENT DOCUMENTS

| | | | |
|---|---|---|---|
| 3,828,544 | 8/1974 | Alker | 57/152 |
| 4,321,854 | 3/1982 | Foote et al. | 87/6 |
| 4,343,343 | 8/1982 | Reuter | 152/359 |
| 4,534,262 | 8/1985 | Swenson | 87/6 |
| 4,563,869 | 1/1986 | Stanton | 57/211 |
| 4,958,485 | 9/1990 | Montgomery et al. | 57/210 |
| 5,597,649 | 1/1997 | Sandor et al. | 428/370 |

*Primary Examiner*—William Stryiewski
*Attorney, Agent, or Firm*—Kennedy, Davis & Kennedy, P.C.

[57] ABSTRACT

A balanced strand includes a fibrous core about which load bearing fibers are twisted. The fibrous core has an elongation factor of at least 10% and comprises approximately up to 30% of the material volume of the strand. The load bearing fibers have an elongation factor less than the fibrous core and a strength of at least 15 g denier. The load bearing fibers comprise the remaining strand material volume.

6 Claims, 2 Drawing Sheets

BALANCED STRAND CORDAGE

TECHNICAL FIELD

The present invention relates to yarns and strands having high breaking strength, and cordage produced therefrom.

BACKGROUND OF THE INVENTION

Conventional cordage products are produced by twisting individual fibers into yarn and then twisting the yarn into strands. Each strand is then twisted or braided into a larger cordage structure. Because of this twisting, the cordage manufacturing process creates different path lengths for the fibers within the yarn and for the yarn within the strands, with the shortest paths being closest to the center of the yarn or strand. The strands may then be twisted or braided into three, four, eight, twelve or more strand cordage.

In the past cordage was made entirely of natural fiber materials. Because of the strength limitations of natural fibers, the stronger natural fiber cords required greater amounts of fibers and were subsequently larger in diameter.

Cordage has more recently been manufactured from high performance, low elongation synthetic fibers, i.e. ultra-high-strength, low weight polyethylene fibers, as opposed to high elongation synthetic fibers which have been used in the past for applications requiring elasticity. For the purposes of this application, high performance synthetic fibers are defined as those fibers with greater than 15 gram denier strength and/or an elongation factor of less than ten percent. High performance fibers include Kevlar™ Aramid™, and Spectra™ 900, 1000, and 2000 generation fibers made of high molecular weight polyethylene made by Allied Signal Inc. As a result of the high strength and low weight of these synthetic fibers, the cords manufactured from these fibers are smaller in diameter and lighter than their natural fiber or generic synthetic predecessors of equivalent strength.

Typically, these synthetic cords are manufactured from one type of synthetic fiber (hereinafter "of homogeneous construction"). Like their natural fiber predecessors, stronger synthetic cords have larger cord diameters.

While offering many advantages over their predecessors, such as increased strength, lower weight and increased weather resistance, high performance synthetic cordage has several disadvantages.

When using conventional high elongation synthetic fibers in the production of synthetic cordage, such as nylon or polyester, the inherent high elongation of such fibers is so great that the different lengths created in the production of the cordage does not pose as important a breaking strength factor as they do for high performance, low elongation synthetic fibers. For instance, the yarn inside a strand typically has the shortest path while the outside yarn has the longest paths. The difference in path lengths increases as the diameter of a strand structure increases. As an example, if the difference between lengths of yarn is 4% and the elongation of the yarn is 20%, the yarn is within 20% of one another's length at maximum load. When the cord is loaded to its maximum tensile strength, all of the yarn will break within 20% of one another's length. In contrast, if the same yarn is used in a cord and the yarn only has 4% elongation, then the yarn with the shortest path breaks before the longest yarn starts to share the load. By minimizing the difference in lengths, all the yarn carries an equal share of the load at the same time, which converts to a high translational energy, i.e., fiber or yarn strengths compared to finished cordage strength. This results in a higher breaking strength. Ideally, if all of the yarn in a strand is placed in parallel relation it has the same length and carries an equal share of the load. Unfortunately, in this arrangement the yarn is not in a form which is useable as a cordage product.

Furthermore the breaking strength of currently manufactured synthetic fibers making up cordage, that is the strength required to rupture the cordage, has plateaued. As a result, in order to produce a stronger synthetic fiber cord, a manufacturer must add more fibers to a cord. This results in cord with a larger diameter, which is often heavy and difficult to manipulate. Finally, since high performance synthetic fibers are costly, the creation of a stronger synthetic cord adds significantly to the final cost of the cord.

Attempts have been made to overcome some of the disadvantages of synthetic fiber cordage. In this regard, cord with reduced snapback construction has been developed having an inner high stretch safety component, such as nylon, and an outer high strength, low elongate synthetic fiber component of an aramid such as Kevlar. This cord also includes an armor component of a high strength, heat resistant synthetic fiber such as Kevlar, braided over the inner safety line, but beneath the high strength component. This type of cord is illustrated in U.S. Pat. No. 4,534,262 to Swenson. While use of the Swenson type mooring line purportedly results in the controlled recoiling of the high strength component down the high stretch line upon rupture, the strength of the line is limited. For instance a Swenson type line of 1.5 inches in diameter has a breaking strength of only 125,000 lbs. The costly materials in the Swenson line are not arranged so as to maximize performance of the high strength components.

A synthetic rope which reduces snap-back has also been developed having one component with high elongation characteristics, and another component with lower elongation characteristics and mass greater than the other component. This is illustrated in U.S. Pat. No. 4,563,869 to Stanton. The Stanton type rope includes a separate core strand of braided synthetic fibers such as nylon or polyester, surrounded by low elongation, high strength braided Kevlar fiber strands. As an alternative, the Stanton type rope has no core strand, but rather has braided, symmetrically opposed pairs of low and high elongation fiber strands. The low elongation fiber strands are distributed around separate high elongation strands in both versions of the Stanton type rope. While the Stanton type rope is designed to reduce snap back, it is not focussed on providing increased strength. Furthermore, its high strength components do not act in concert to boost the overall strength of the rope.

While cordage has been created for reducing the risk of snap-back, demand still exists for high performance synthetic cordage with high breaking strengths, low weight, and of manageable size. The high costs of the synthetic fibers which make up such cordage has deterred the development and use of low elongation, high strength cordage which simply uses greater amounts of synthetic fibers to achieve this result.

It thus is seen that a need remains for a synthetic cord which provides greater breaking strength but having less synthetic fiber than would normally be required for a single type synthetic fiber cord of comparable strength. Furthermore, a need remains for a synthetic cord which provides greater breaking strength by having all of the synthetic fibers carry an equal share of the load at the same time. Accordingly, it is to the provision of such cordage that the present invention is primarily directed.

SUMMARY OF THE INVENTION

In a preferred form of the invention, a balanced strand has a fibrous core about which load bearing fibers are twisted.

The fibrous core has an elongation factor greater than that of the load bearing yarns and occupies up to 30% of the strand material volume. The load bearing fibers have an elongation factor less than that of the core fibers and a strength of at least 15 gram denier. The load bearing fibers occupy the remaining portion of the strand material volume.

The load bearing fibers can encompass two or more different types of high performance fibers. In this regard, each fiber type has a different strength and elongation factor. When the load bearing fibers encompass more than one type of high performance fiber, the high performance fibers with the lower strength and the higher elongation are twisted proximately about the fibrous core. The fibers with the lower elongation are twisted about the lower strength fibers. The lower elongation fibers are therefore twisted distally about the fibrous core. Multiple balanced strands may be twisted to form a cord with high breaking strength.

DETAILED DESCRIPTION

It has now been discovered that a strand having a fibrous core comprising up to 30% of the strand's material volume excluding air spaces, and having an elongation factor of at least 10%, about which are twisted high performance fibers with a lower elongation factor than the fibrous core, having at least 15 gram (hereinafter (g)) denier strength and comprising the remainder of the strand's material volume (excluding air spaces), exhibits unexpectedly high breaking strength.

In large cord, the size of the yarn components of the strands making up the cord is typically also large. The yarn components of a large cord may have the same structure as the strands within the cord. The term "strand" as used herein therefore means yarn also. It should of course be understood that the fibers within a strand are first twisted into yarn before being twisted into a strand.

To achieve as close to a balanced load bearing capacity of the fibers in a strand, that is to have each of the load bearing fibers carry as equal share of a load as possible, high elongation fibers are used for the shortest paths at the core of the strand. Low elongation, high strength fibers i.e. high performance fibers, are preferably used in the longer fiber paths surrounding the core. The high elongation fibers provide spacer support for the load bearing fibers without contributing to the strength of the strand. This arrangement is in sharp contrast to conventional high performance fiber cord of homogeneous construction in which many of the high performance fibers which carry little load. In a balanced strand the difference between the longest and shortest load bearing fibers is reduced, when compared with synthetic cords of homogeneous construction. Consequently, it is believed that the load bearing fibers are carrying an equal share of the load at the same time.

Figure 1:
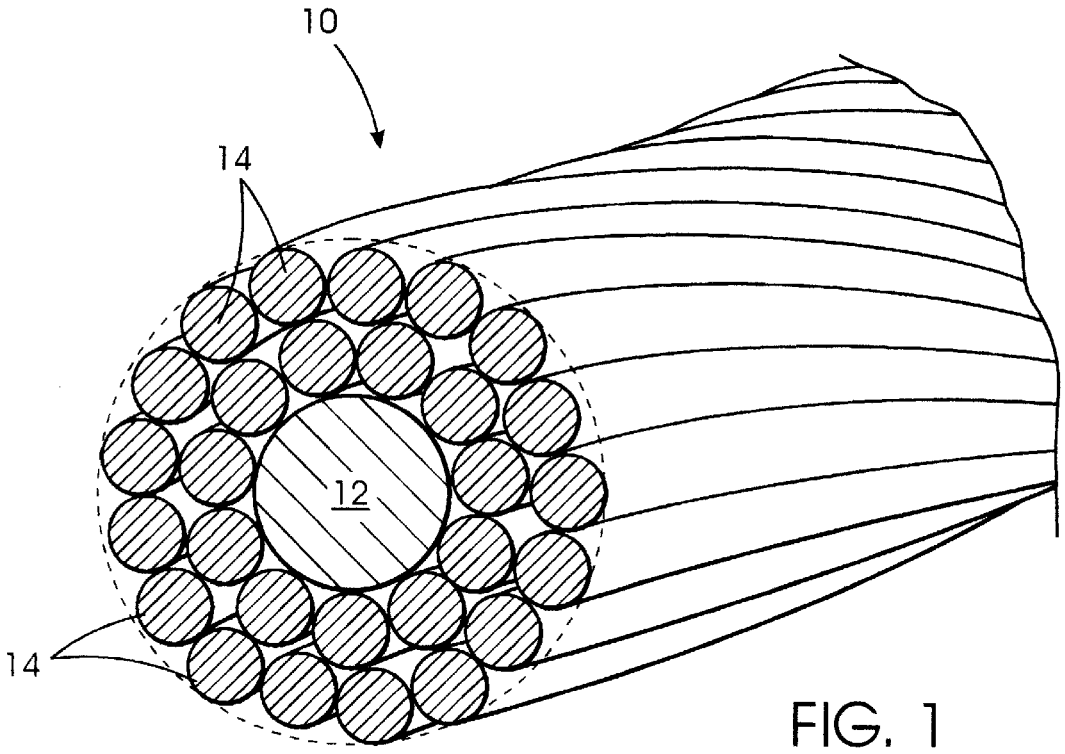
FIG. 1 is a cross sectional view of a single yarn or strand that embodies principles of the invention in a preferred form.

With reference to the drawings, there is shown in FIG. 1 a cross-sectional view of a balanced strand 10, in accordance with the present invention. The strand 10 has a high elongation fibrous core 12 about which load bearing fibers 14 are twisted. The load bearing fibers 14 are distributed evenly around the fibrous core 12 so that the entire fibrous core perimeter is covered with at least a layer of load bearing fibers.

The fibrous core 12 comprises up to 30% of the strand's material volume. It has been found that if a core comprises significantly greater than 30% of a strand's material volume, the size of the resulting strand becomes too large and the breaking strength gain is diminished in the overall performance of the structure. The fibrous core 12 is comprised of high elongation fibers having an elongation factor of approximately 10% or greater, that is the ability to stretch up to 10% of its length. Examples of such core fibers are nylon and polyester fibers.

The load bearing fibers 14 are high performance fibers which are uniformly twisted about the fibrous core 12. The high performance fibers have an elongation of less than ten percent. Preferably, high performance fibers comprise the remainder of the strand's material volume and are preferably twisted in two or more layers about the fibrous core.

Examples of such high performance fibers include high molecular weight polyethylene fibers sold under the names Spectra 900 and Spectra 1000 and having elongation factors of approximately 4 and 3 percent respectively.

Figure 2:
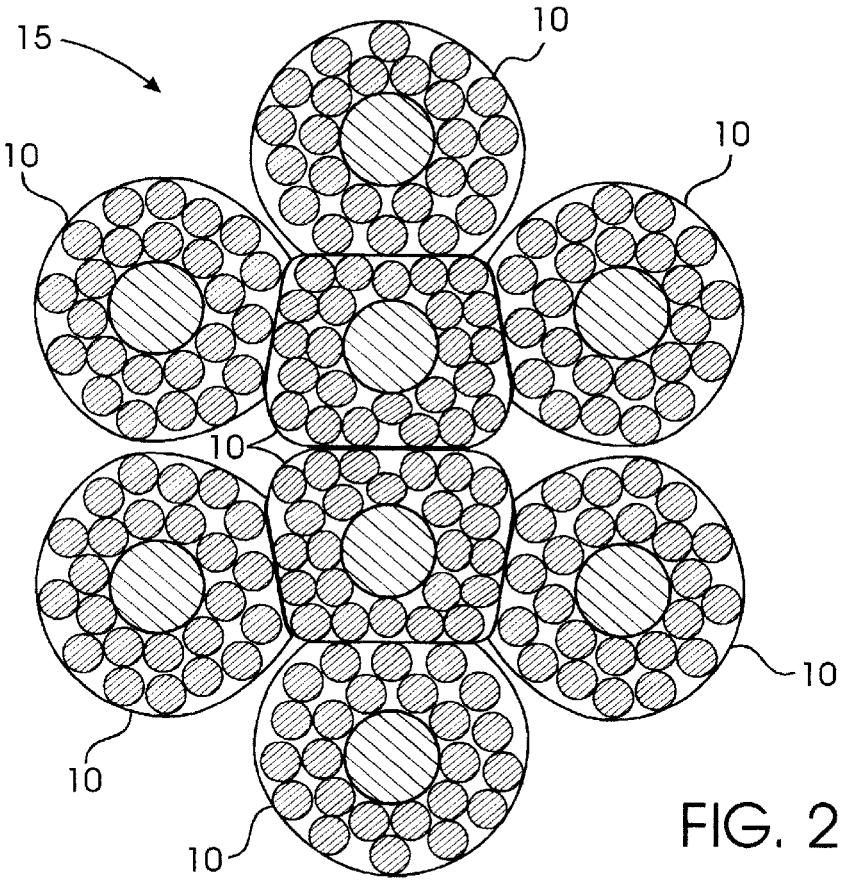
FIG. 2 is a cross sectional view of cordage that embodies principles of the invention having eight of the balanced strands.

In a preferred embodiment, the balanced strand is comprised of a three-ply polyester yarn fibrous core having between 14%–16% elongation factor and comprising approximately 30% of the strand's material volume. The polyester yarn is surrounded by a high molecular weight polyethylene fiber sold under the name Spectra 900, of 28 g denier and having a 4% elongation factor. The high performance fibers occupy approximately 70% of the strand's material volume. Two layers of the high molecular weight polyethylene yarn are twisted about the fibrous core. A number of these strands may be braided into a cord 15 as shown in FIG. 2. In this manner, the load bearing fibers are distributed around multiple fibrous cores throughout the finished cord.

Figure 3:
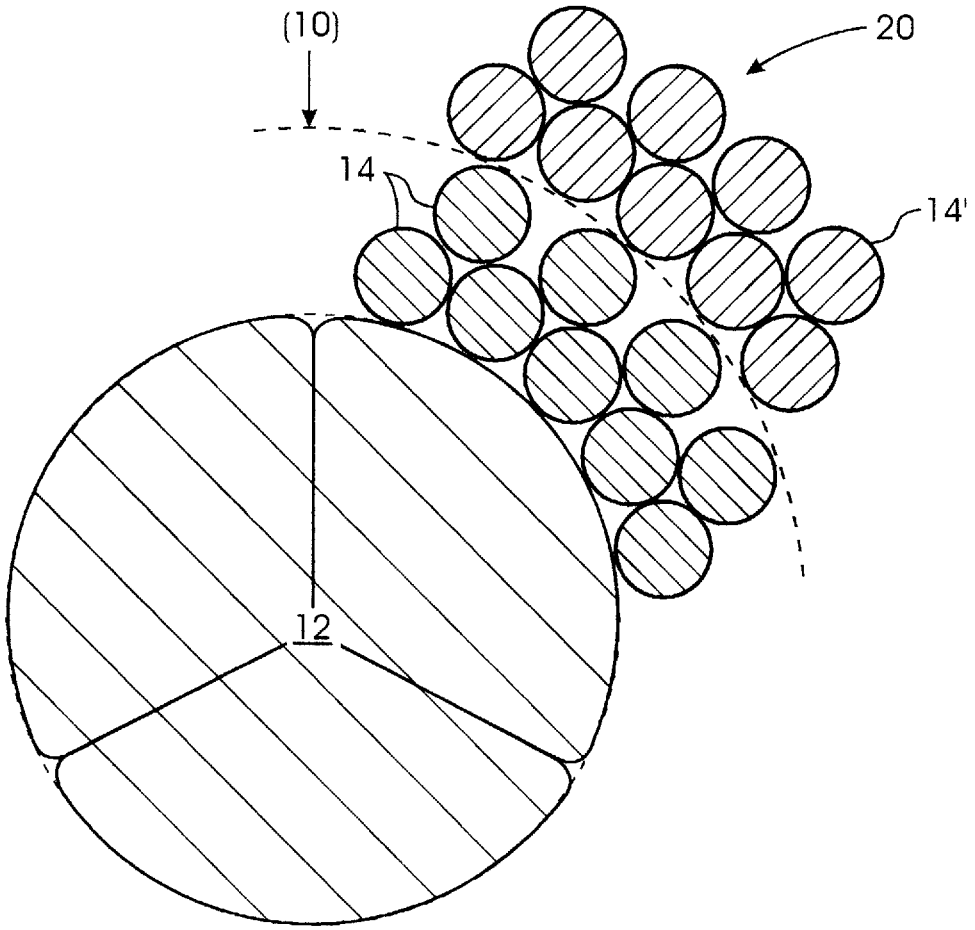
FIG. 3 is a partial cross sectional view of an alternate embodiment of a strand for making up cordage that embodies principles of the invention.

In an alternative embodiment, as illustrated in FIG. 3, a balanced strand 20 includes two different types of high performance, load bearing fibers 14 and 14', each having an elongation factor less than that of the fibrous core 12. The high performance, load bearing fibers 14 with the highest elongation factors are twisted proximately about the fibrous core 12. The high performance, load bearing fibers with the lowest elongation factors 14' are twisted around the high performance fibers with the higher elongation factor 14 and distally about the fibrous core 12. The two types of high performance fibers are preferably distributed in two or more layers each, with each type of high performance fiber having a different length path with respect to the fibrous core 12.

Preferably, the multiple types of high performance fibers comprise between 75%–80% of the strand's volume and are twisted in four layers about the fibrous core, with each type twisted in two layers. An example of a multiple type, high performance fiber balanced strand has a three ply fibrous core of polyester yarn having a 16% elongation factor occupying approximately between 20% and 25% of the strand's material volume. The two different types of high performance fibers which surround the fibrous core are each high molecular weight polyethylene fibers, specifically Spectra 900 yarn having 28 g denier and 4% elongation, and Spectra 1000 yarn having 35 g denier and 3% elongation.

A breaking strength test for each embodiment of the balanced strand cordage reveals a breaking strength significantly greater than comparable ropes of equal size currently available. The results of this test are presented in the following table.

COMPARISON OF TENSILE STRENGTH OF ALTERNATIVE CORD PRODUCTS

| | 1 Type of high performance fiber Spectron 8 (SK-60) | 8 Strand 1 Type of balanced strand w/core (Spectra 900) | | 8 Strand 2 Type of balanced strand w/cores (Spectra 900 and 1000) | | 1 Type of high performance fiber Spectron 8 (SK-60) |
|---|---|---|---|---|---|---|
| Size Dia. Inch | 2 | 2 | 2⅝ | 2 | 2⅝ | 2⅝ |
| Avg. Tensile lbs. | 270,862 | 297,000 | 500,000 | 342,000 | 613,000 | 454,637 |

In the above table, the synthetic Spectron 8 cord is of homogeneous construction. Each of the balanced 8 strand cords consist either of one type of high performance fiber (the same or comparable to that found in Spectron 8) twisted about a core of polyester, or multiple types of high performance fibers twisted about a fibrous core.

The test reveals a 10% increase in tensile strength over the Spectron 8 product for 2 inch diameter cords having strands of a single type high performance fiber twisted about a fibrous core. A balanced strand cord having two different types of high performance fibers as load bearing fibers demonstrates an even higher breaking strength value when compared with the same size diameter synthetic cord of homogeneous construction. Finally, a comparison of 2⅝ inch cord of homogeneous construction, with single and multiple type high performance balanced strand cord, reveals significantly higher breaking strength for both types of balanced strand cords. The balanced strands and cords incorporating the balanced strands exhibit greater breaking strength because the difference between the longest and shortest load bearing fibers in the strands is reduced, when compared with synthetic cords of homogeneous construction and consequently, the load bearing fibers are carrying an equal share of the load at the same time. The improved strand absorbs the shock load or energy at a higher level than other constructions used today.

It therefore can be seen that the described balanced strand and cordage construction provides increased breaking strength without the need for additional high performance fibers as is required for conventional high performance strands of homogeneous construction.

While this invention has been described in detail with particular references to the preferred embodiments thereof, it should be understood that many modifications and additions may be made thereto, in addition to those expressly recited, without departure from the spirit and scope of the invention as set forth in the following claims.

I claim:

1. A balanced strand comprising a fibrous core about which load bearing fibers are twisted, wherein said fibrous core has an elongation factor of at least 10% and wherein said load bearing fibers have a strength of at least 15 g denier, and wherein said fibrous core occupies approximately up to 30% of the strand material volume and said load bearing fibers occupy substantially the remainder of the strand material volume.

2. The balanced strand of claim 1 wherein said load bearing fibers include a first type of load bearing fibers proximate to said fibrous core and a second type of load bearing fibers distal to said fibrous core, wherein said proximate load bearing fibers has a given elongation factor, and wherein said distal load bearing fibers has an elongation factor less than that of said proximate load bearing fibers.

3. The balanced strand of claim 2 wherein said fibrous core occupies between approximately 20% and 25% of the strand material volume.

4. The balanced strand of claim 3 wherein said fibrous core has an elongation factor of approximately 14%, wherein said proximate load bearing fiber has an elongation factor of approximately 4%, and wherein said distal load bearing fiber has an elongation factor of approximately 3%.

5. The balanced strand of claim 4 wherein said fibrous core is polyester, wherein said proximate and distal load bearing fibers are high molecular weight polyethylene.

6. The balanced strand of claim 5 wherein said proximate and distal load bearing fibers have elongation factors of approximately 4% and 3% respectively.

* * * * *